US010829965B2

(12) United States Patent
Farris et al.

(10) Patent No.: US 10,829,965 B2
(45) Date of Patent: Nov. 10, 2020

(54) DOOR LATCH DEVICE

(71) Applicant: GECOM CORPORATION, Greensburg, IN (US)

(72) Inventors: Bryan Farris, Novi, MI (US); Brian Kepler, Novi, MI (US); Aaron Martin, Novi, MI (US)

(73) Assignee: Gecom Corporation, Greensburg, IN (US)

( * ) Notice: Subject to any disclaimer, the term of this patent is extended or adjusted under 35 U.S.C. 154(b) by 588 days.

(21) Appl. No.: 15/557,047

(22) PCT Filed: Mar. 10, 2015

(86) PCT No.: PCT/JP2015/057071

§ 371 (c)(1),
(2) Date: Jan. 2, 2018

(87) PCT Pub. No.: WO2016/143081

PCT Pub. Date: Sep. 15, 2016

(65) Prior Publication Data

US 2019/0112841 A1 Apr. 18, 2019

(51) Int. Cl.

| | |
|---|---|
| ***E05B 77/26*** | (2014.01) |
| ***E05B 77/28*** | (2014.01) |
| ***E05B 79/08*** | (2014.01) |
| ***E05B 81/06*** | (2014.01) |
| ***E05B 77/24*** | (2014.01) |
| ***E05B 81/16*** | (2014.01) |

(52) U.S. Cl.

CPC ..... *E05B 77/26* (2013.01); *E05B 77/245* (2013.01); *E05B 77/28* (2013.01); *E05B 79/08* (2013.01); *E05B 81/06* (2013.01); *E05B 81/16* (2013.01); *E05Y 2900/531* (2013.01)

(58) Field of Classification Search

None

See application file for complete search history.

(56) References Cited

U.S. PATENT DOCUMENTS 6,003,910 A * 12/1999 Dupont ..... E05B 77/26 292/201

2009/0241617 A1 10/2009 Takahashi et al.

FOREIGN PATENT DOCUMENTS

| | | | | |
|---|---|---|---|---|
| EP | 1158125 A1 * | 11/2001 | ..... | E05B 77/24 |
| GB | 2452373 A * | 3/2009 | ..... | E05B 77/26 |
| GB | 2458549 A * | 9/2009 | ..... | E05B 77/26 |

(Continued)

OTHER PUBLICATIONS

International Search Report and Written Opinion of the International Searching Authority, dated Jun. 2, 2015, for corresponding International Application No. PCT/JP2015/057071, 6 pages.

*Primary Examiner* — Alyson M Merlino

(74) *Attorney, Agent, or Firm* — Klarquist Sparkman, LLP

(57) ABSTRACT

Provide a door latch device that allowing a childproof-double-lock mechanism is simplified and the size of the door latch device is miniaturized. While supporting a childproof lever and a double lock lever by a support shaft, coordinating the childproof lever and the double lock lever by an interlocking means and for moving the double lock lever in the direction of a double-lock position in conjunction with the childproof lever and the double lock lever move to the 3rd position from the 2nd position where is a childproof lock position.

4 Claims, 13 Drawing Sheets

(56) References Cited

FOREIGN PATENT DOCUMENTS

| | | | |
|---|---|---|---|
| JP | 4422747 | B | 2/2009 |
| JP | 4473919 | B | 10/2009 |

* cited by examiner

DOOR LATCH DEVICE

CROSS REFERENCE TO RELATED APPLICATIONS

This is the U.S. National Stage of International Application No. PCT/JP2015/057071, filed Mar. 10, 2015.

TECHNICAL FIELD

The present invention relates to a door latch device in a motor vehicle and particularly to a door latch device comprising a double locking mechanism for disabling unlocking operation of a lock knob provided inner side of the vehicle and a childproof locking mechanism for disabling a door opening operation by an inside handle provided inner side of the vehicle.

BACKGROUND

Among known door latch devices, besides a normal lock/unlock mechanism capable of changing between an unlocking state that enabling a door open operation and a locking state that disabling the door open operation, some of them comprise a double locking mechanism that prevents the lock/unlock mechanism changed into the unlocking state illegally by the unlocking operation of the lock knob provided inner side of the vehicle from outside of the vehicle, and a childproof structure for preventing a door from opening carelessly even if an inside handle is operated by a child seated in the vehicle (See JP patent 447391962).

PRIOR ART DOCUMENTS

[Patent Document 1] JP patent 447391962

SUMMARY

Problem to be Solved by the Invention

The door latch device disclosed in JP patent 44739196 comprises; an actuating member driven between a first position and a third position by a childproof-double-lock motor; and a childproof lever (a childproof lock lever), one end of the childproof lever is connected to the actuating member, the childproof lever is supported on an axis spaced from a pivot of the actuating member and is changed from a childproof unlock state to a childproof lock state when the actuating member moved from the first position to a second position, wherein, when the actuating member moved from the second position to the third position, a blocking portion provided on an arm extended from the actuating member hits a second subsidiary lever (an open link), and restricts the second subsidiary lever in a locked position, so that changes the second subsidiary lever into a double lock state.

According to the door latch device disclosed in JP patent 44739198, the operation for changing the childproof lever to the childproof locking state and the double locking state is carried out by the actuating member driven by the childproof-double-lock motor.

Since an operating space for the big arm which restricts the second subsidiary lever in the locking position is large, there are problems that the structure of the childproof-double-lock mechanism is complicated, a big space must be secured for storing the actuating member which has the arm in a casing wherein the childproof-double-lock mechanism, therefor, the casing and, in turn, the door latch device is increased in size.

In view of the above problems, it is an object of the subject invention to provide a door latch device that allowing the childproof-double-lock mechanism is simplified and the size of the door latch device can be miniaturized.

Means for Solving Problem

The problems are solved by the present invention as follows.

The 1st invention comprising; an engagement unit having an engagement mechanism adapted to engage with a striker of a vehicle body; and an actuator unit combined with the engagement unit and having an operation mechanism for operating the engagement mechanism, wherein the operation mechanism comprises;

an inside lever carries out a release operation based on a door opening operation of an inside handle provided in the door inside the vehicle;

a lock/unlock lever movable to an unlocking position and a locking position, based on an operation of a lock knob for locking and unlocking operations provided in the door inside the vehicle;

an open link movable to the unlocking position and the locking position, interlocked with the lock/unlock lever, wherein, when in the unlocking position, enabling to release an engagement of the engagement mechanism and the striker based on a release operation of an outside handle provided in the door outside of the vehicle, and when in the locking position, disabling to release the engagement, a childproof lock mechanism movable to a first position where is a childproof unlocking state that transferring the release operation of the inside lever to the engagement mechanism and enabling to release the engagement of the engagement mechanism with the striker, and a second position where is a childproof locking state that the transferring is disabled and disabling release operation from the engagement of the engagement mechanism with the striker, a double lock lever movable to a double unlocking position where allowing the movement of the open link into the locking position or to a double locking position where blocking the movement of the open link into the unlocking position; and a motor for moving the childproof lever to the first position, the second position, and a third position where passed through the second position, and movable double lock lever to the double locking position by moving of the childproof lever to the third position, wherein, while supporting the childproof lever and the double lock lever by a support shaft, interlocking the childproof lever and the double lock lever by an interlocking means so as to be moved the double lock lever to the double locking position linked with the movement of the childproof lever to the third position.

According to the 2nd invention, in the 1st invention, wherein the interlocking device comprises; a drive section provided in the childproof lever side; and a driven section provided in the double lock lever side, wherein, when the childproof lever passes the second position and moves to the third position, the drive section hits the driven section and the double lock lever is moved to the double locking position by the childproof lever.

According to the 3rd invention, in the 2nd invention, wherein the drive section and the driven section are provided in facing surfaces of a central part supported by the support shaft in the childproof lever and the double lock lever, According to the 4th invention, in the 3rd invention, wherein the driven section is provided separating in the direction of the circumference centered on the support shaft, and is prepared two pieces having a space formed between the two driven sections, the drive section is fitted so that predetermined angle rotation can be carried out centered on the support shaft, and when the childproof lever passes the second position and moves to the third position, and when moving to the first position from the third position, the drive section hits the driven section in the rotation direction, so that the double lock lever linked with the childproof lever is moved to the double locking position direction or to the double unlocking position direction, respectively.

According to the 5th invention, in any one of the above 1st-the 4th invention, wherein, the open link and the double lock lever are arranged so that at least one part of them are facing to each other, a blocked portion is prepared on the facing surface of the open link, and a blocking portion is prepared on the facing surface of the double lock lever link, respectively, wherein, when the open link is in the locking position and the double lock lever is double locking position, the blocking portion approaches or hits the blocked portion, so that the movement of the open link in the unlocking position direction is blocked.

The Effect of Invention

According to the present invention, since the childproof lever is directory driven by the motor so as to be movable in the first position, the second position, and the third position passing through the second position, and when the childproof lever moved to the first position, the childproof lock mechanism is changed to the childproof unlocking state, when the childproof lever moved to the second position, the childproof lock mechanism is changed to the childproof locking state, respectively, the childproof lever and the double lock lever are supported on a common support shaft to form a coaxial. Furthermore, since the childproof lever and the double lock lever are interlocked by an interlocking means, and when the childproof lever moves to the third position, the double lock lever is moved to the double locking position. So that, the childproof locking and the double locking mechanism are simplified, and the miniaturization of the door latch device can be attained.

DESCRIPTION OF THE EMBODIMENTS

Hereinafter, an embodiment of the present invention is described by reference to drawings.

Figure 1:
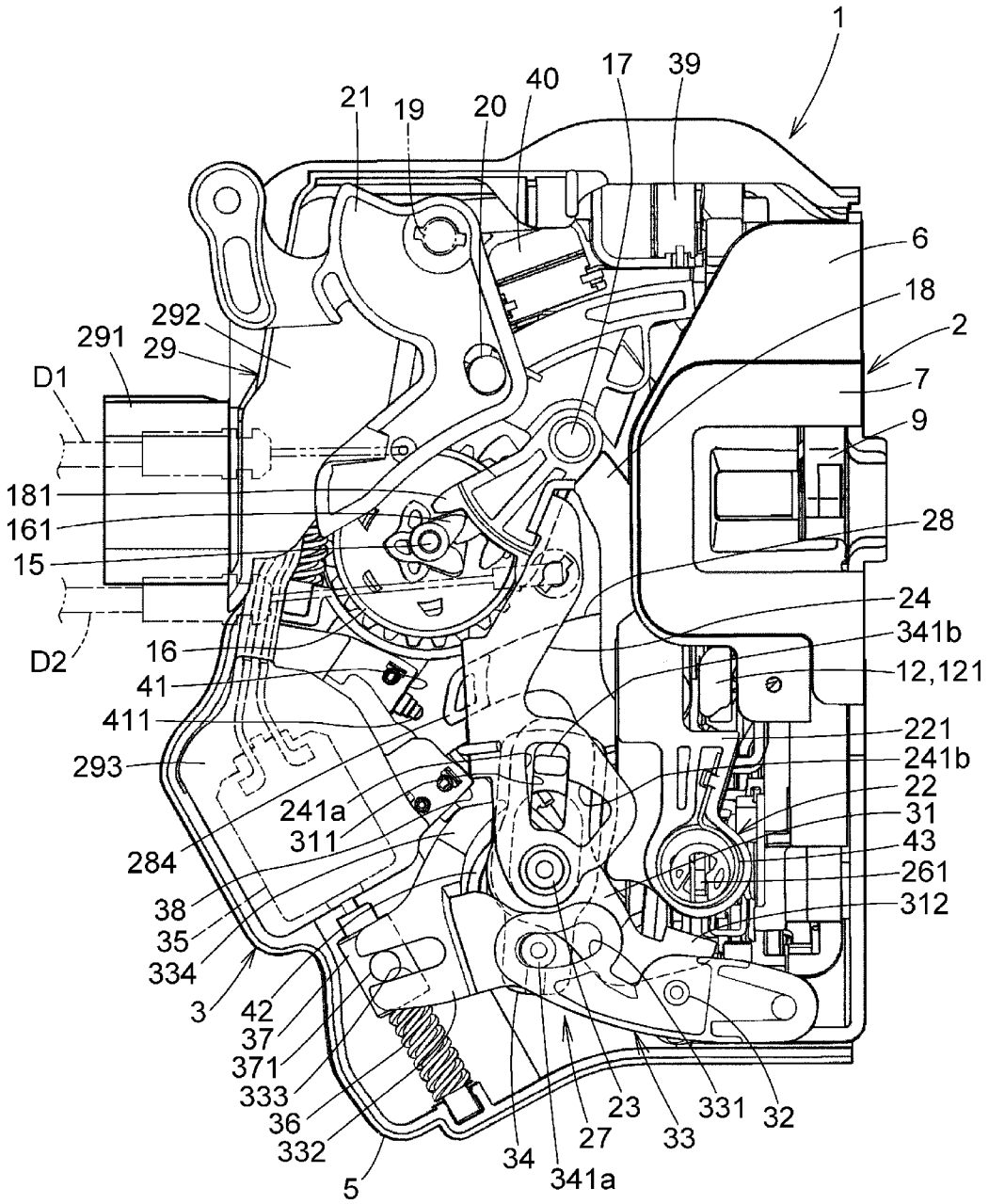
FIG. 1 is a side view of a door latch device according to the present invention of which a cover is removed, seen in a direction of an inner side of a vehicle.
Figure 2:
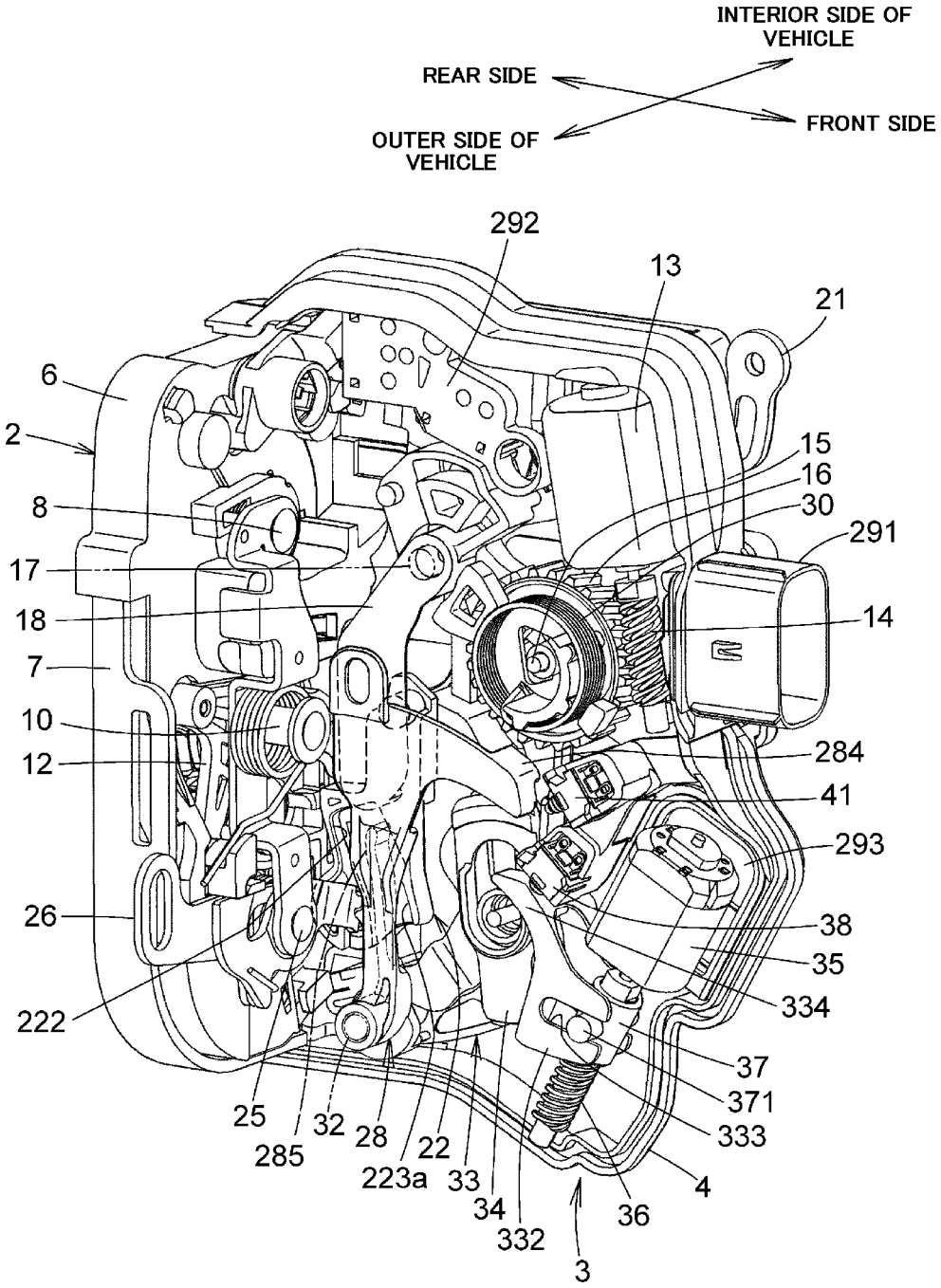
FIG. 2 is, the same, a perspective view according to the present invention of which a casing is removed, seen in a direction of diagonally in front of the outside of the vehicle.
Figure 3:
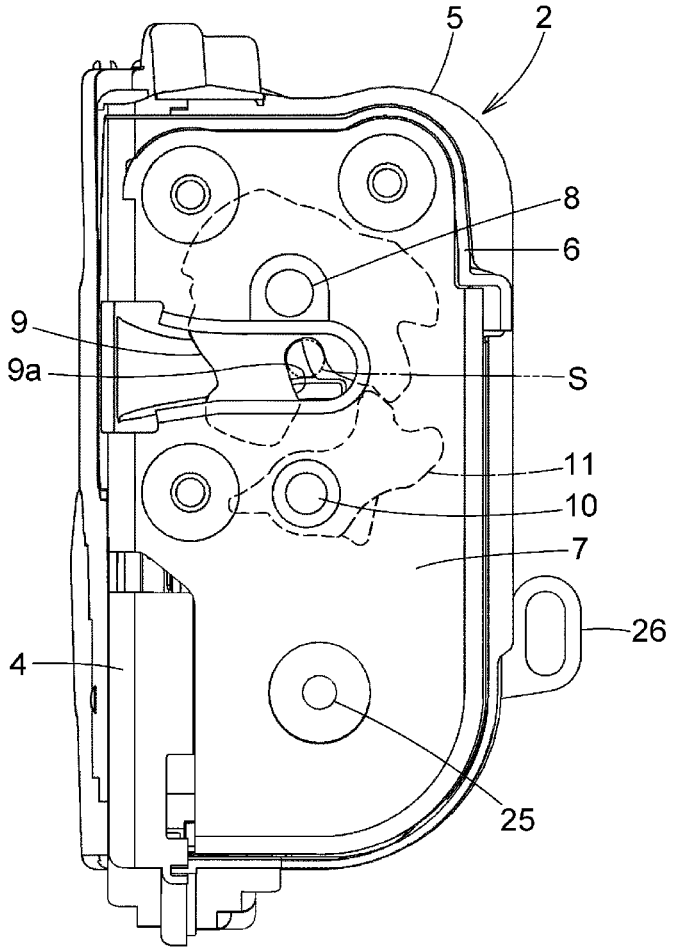
FIG. 3 is, the same, a rear elevational view of the door latch device.

As shown in FIGS. 1-3, a door latch device 1 is disposed at a rear end in a rear door (herein after, a door for short) of a vehicle (not shown), and comprises an engagement unit 2 for holding the door in a closed position and an actuator unit 3 integrally connected with the engagement unit 2 and operable an engagement unit (described later) of the engagement unit 2.

For specifying the internal structure of the actuator unit 3, in FIG. 1, a cover 4 which covers the actuator unit 3 on the inner side of the vehicle is omitted, in FIG. 2, a casing 5 which covers the actuator unit 3 on the outer side of the vehicle and covers the front of the engagement unit 2 is omitted, respectively.

As shown in FIG. 3, the engagement unit 2 comprises a body 6 made of a synthetic resin of a box shaped in which a rear surface is opened, a cover plate 7 made of metal fixed to the rear surface of the body 6, and fixed to an inside surface of a rear end of an inner panel of the door, together with the body 6, by plural bolts (not shown), a latch 9 supported by a latch axis 8 extending in a longitudinal direction and is accommodated in an interior space between the body 6 and the cover plate 7 and has an engagement groove 9*a* in which a striker S of the vehicle body side is engageable, a ratchet 11 supported by a ratchet axis 10 extending to a longitudinal direction and is accommodated in the interior space between the body 6 and the cover plate 7 and prevents the rotation of the latch 9 into an open direction (a direction which release the engagement of the latch with the striker S) by engaging with the latch 9, and an open lever 12 fixed to the ratchet axis 10 at the front side of the body 6 and rotates integrally with the ratchet 11 (See FIG. 1, FIG. 2).

The latch 9 and the ratchet 11 are correspond to an engagement mechanism of the present invention.

The actuator unit 3 comprises;

the casing 5 made of the synthetic resin and is fixed to the body 6 of the engagement unit 2;

a lock/unlock motor 13 which rotates in forward-reverse direction based on an operation by a remote controller switch (not illustrated) etc. and is accommodated in a front upper part of the casing 5 where a rotation axis of the lock/unlock motor is slanted obliquely downward direction;

a worm gear 14 fixed to an axis of the lock/unlock motor 13 which is slanted toward down direction, a worm wheel 16 engaging with the worm gear 14 and is pivoted on the casing 5 by a shaft 15 facing to the inside and the outside direction of the vehicle;

a lock/unlock lever 18 pivoted on the casing 5 by a shaft 17 facing to the inside and the outside direction of the vehicle and is movable to an unlocking position where enable opening the door and a locking position where disable opening the door;

a knob lever 21 pivoted by a shaft 19 provided on an upper part of the cover 4 facing to the outer direction of the vehicle, and is connected to a lock knob (not shown) by an open operation power transfer member D1, such as a bowden cable, for a manual operation provided inner side of the vehicle of the door, and is connected to a pin 20 of which the lower part is prepared in the upper end part of the lock/unlock lever 18 and facing the inside direction of the vehicle;

an open link 22 interlocked with the lock/unlock lever 18 and is movable to the unlocking position and the locking position;

an inside lever 24, a lower end part of which is pivoted by a shaft 23 provided on the casing 5 and facing to the inside and the outside direction of the vehicle, an upper part of which is connected to an inside handle (not shown) by an operation power transfer member D2, such as a bowden cable, in upper part near a childproof lever 33 mentioned later;

an outside lever 26 pivoted by a shaft 25 provided in forward and backward direction of the body 6 and connected to an outside handle (not shown) prepared in the outside of the vehicle door by a rod etc. (not shown);

a childproof lock mechanism 27 capable of changing the door open operation by the inside handle into a childproof unlocking state where enable transferring the door open operation to the open link 22 and the ratchet 11 of the engagement unit 2 through the inside lever 24, or into a childproof locking state where disable transferring the door open operation, a double lock lever 28 linked to the open link 22 and the childproof lock mechanism 27, and is movable to a double unlocking position where the movement of the open link to the locking position is allowable or to a double locking position where the movement of the open link 22 to the unlocking position is disable; and a switch plate 29 having a female connector 291 to which an external power connector (not shown) is connected.

In addition, the above lock/unlock motor 13, the worm wheel 16, the lock/unlock lever 18, the knob lever 21, the open link 22, the inside lever 24, the childproof lock mechanism 27, the double lock lever 28, and a childproof-double-lock motor 35 mentioned later etc. are corresponds to an operation mechanism of the present invention.

The worm wheel 16 rotates forward reverse rotation from a neutral position against the force of a spring 30, based on the forward/reverse rotation of the lock/unlock motor 13, and when the rotation of the lock/unlock motor 13 stops, the worm wheel returns to the neutral position automatically from the rotated position by the force of the spring 30.

The lock/unlock lever 18 has a gear 181 which is engaged to a gear portion 161 prepared in the central part of the worm wheel 16, and is rotated to the unlocking position where enable to open the door by the outside handle and the inside handle, or to the locking position where disable to open the door, by the forward/reverse rotation of the worm wheel 16 based on the rotation of the lock/unlock motor 13.

The knob lever 21 is rotatable to the unlocking position and the locking position based on locking and unlocking operations of the lock knob. When the lock knob is operated to the locking position, it rotates a predetermined angle in a counterclockwise direction from the unlocking position shown in FIG. 1 and it moves to the locking position (See FIG. 12).

Figure 10:
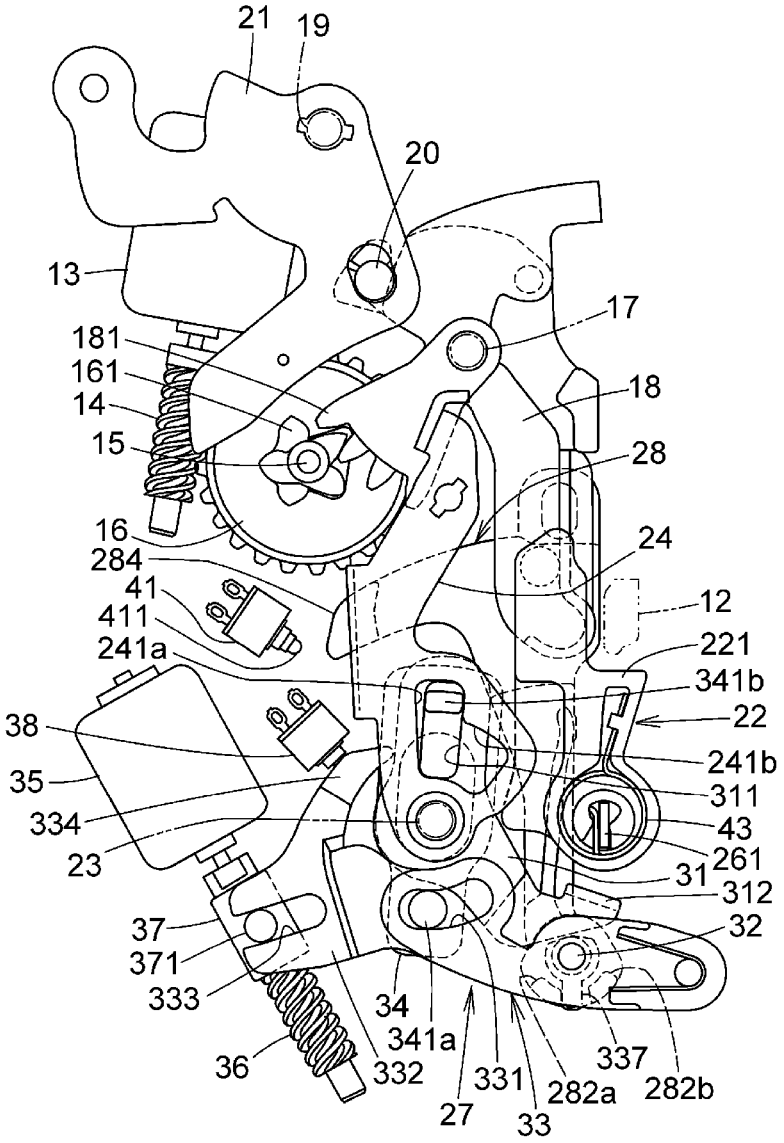
FIG. 10 is a side view of the principal part of the door latch device when the childproof lever is a childproof unlocking state, seen in the direction of the inner side of the vehicle.
Figure 12:
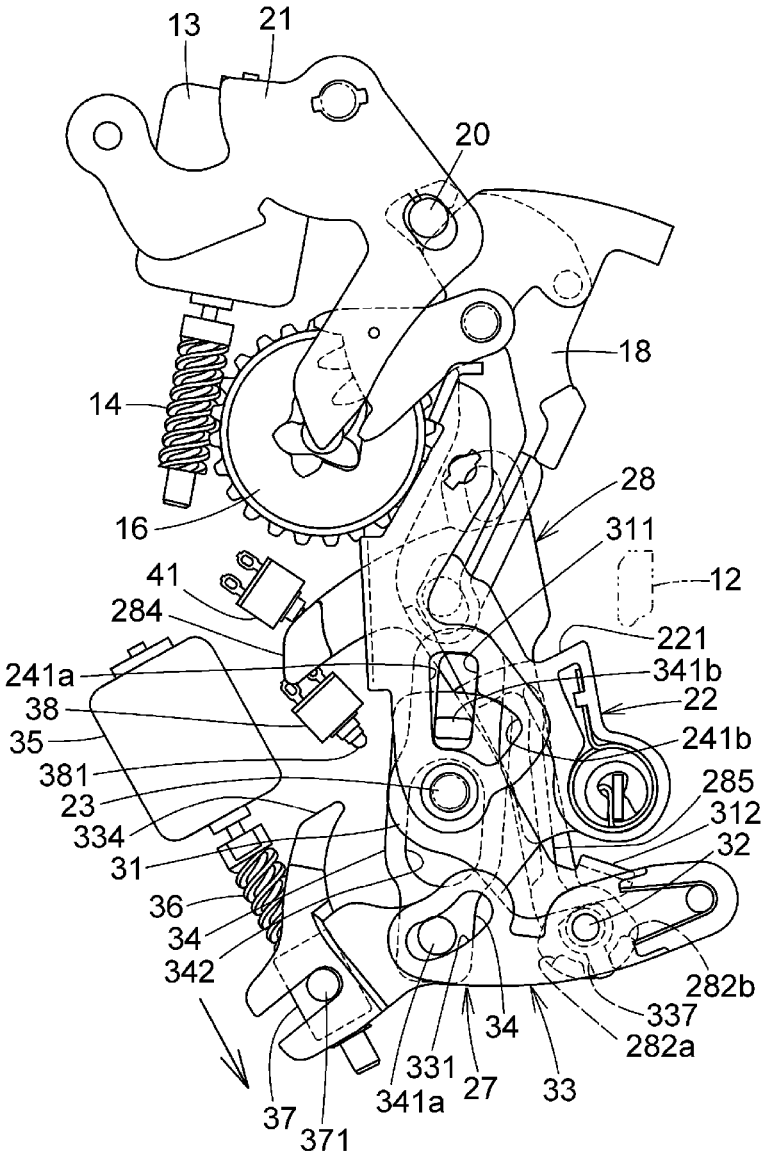
FIG. 12 is a side view of the principal part of the door latch device when the double lock lever is a double locking state, seen in the direction of the inner side of the vehicle.

At this moment, the lock/unlock lever 18 connected with the knob lever 21 and the open link 22 connected with the lock/unlock lever 18 are rotated to the unlocking position where enable to open the door by the outside handle and the inside handle, or to the locking position where disable to open the door (See FIG. 10 and FIG. 12).

The inside lever 24 is arranged between the open link 22 and the childproof-double-lock motor 35 which are mentioned later, and rotates to the counterclockwise direction in FIG. 1 against the force of a spring 42 by an open operation of the inside handle. When the lock/unlock lever 18 is in the unlocking position and the childproof lock mechanism 27 is in the childproof unlocking state, by rotating the open lever 12 in the release direction by a release lever 31 (mentioned later) connected with the inside lever 24 and the open link 22, the engaging of the ratchet 11 and the latch 9 is released so that the door is openable.

In the lower part of the inside lever 24 near the axis 23, a L-shaped fitting hole 241 is formed. In the fitting hole 241, an upper connecting projection 341*b* formed on a connect lever 34 mentioned later can be engaged therein (refer to FIG. 4).

In a vertically long hole 241*a* in the up and down direction of the upper part of the fitting hole 241, when the childproof lock mechanism 27 is in the childproof unlocking state, the upper connecting projection 341*b* is slidably engaged therein in the up-and-down direction, so that, during door opening operation by the inside handle, drive power of the inside lever 24 into the release direction is transmittable to the release lever 31 mentioned later via the upper connecting projection 341*b*.

Further, when the childproof lock mechanism 27 is in the childproof locking state, the upper connecting projection 341*b* moves into a wide backward hole 241*b* continued to the vertically long hole 241*a* and facing to the back side (counter direction to the release operation direction of the inside lever) in the lower part.

Thereby, when the door opening operation is carried out by the inside handle, the inside lever 24 is let to swing away, so that the release operation of the inside lever 24 is not transmitted to the release lever 31 through the upper connecting projection 341*b* (Detailed explanation is mentioned later).

The lower part of the open link 22 is connected to a connection end 261 of the outside lever 26 where is an inner side of the vehicle in a state that predetermined angle rotation to the front-back direction is possible and the upper part of the open link 22 is connected to the lock/unlock lever 18 in a state that movable in the vertically direction, and moves conjunction with the rotation of the lock/unlock lever 18 and rotates around the connection end 261 of the outside lever 26 against the force of a spring 43, from the unlocking position shown in FIG. 1 to the locking position where rotated a predetermined angle to a counterclockwise direction.

When the open link 22 is in the unlocking position, the upper surface of a cancel release part 221 provided in the intermediate part of the up-and-down direction of the open link 22 becomes enable to contact to the undersurface of the cancel released part 121 of the open lever 12.

When the door is in a fully closed state and the lock/unlock lever 18 and the open link 22 are in the unlocking position, if the outside lever 26 carries out a release operation based on the open operation of the outside handle, the open link 22 moves upwards and rotates the open lever 12 to the release direction, the engaging state of the ratchet 11 which rotate in one with the open lever 12 and the latch 9 is canceled, so that the door can be opened (See FIG. 10).

When the door is locked in the fully closed state, if the lock/unlock lever 18 and the open link 22 are moved to the locking position by operating the lock/unlock motor 13 in the lock direction utilizing a control switch for mobile etc., even if the open link 22 moves upward by the release operation of the outside lever 26, since the cancel release part 221 swings away to a cancel released part 121 of the open lever 12, so that the door cannot be opened (See FIG. 12).

Figure 4:
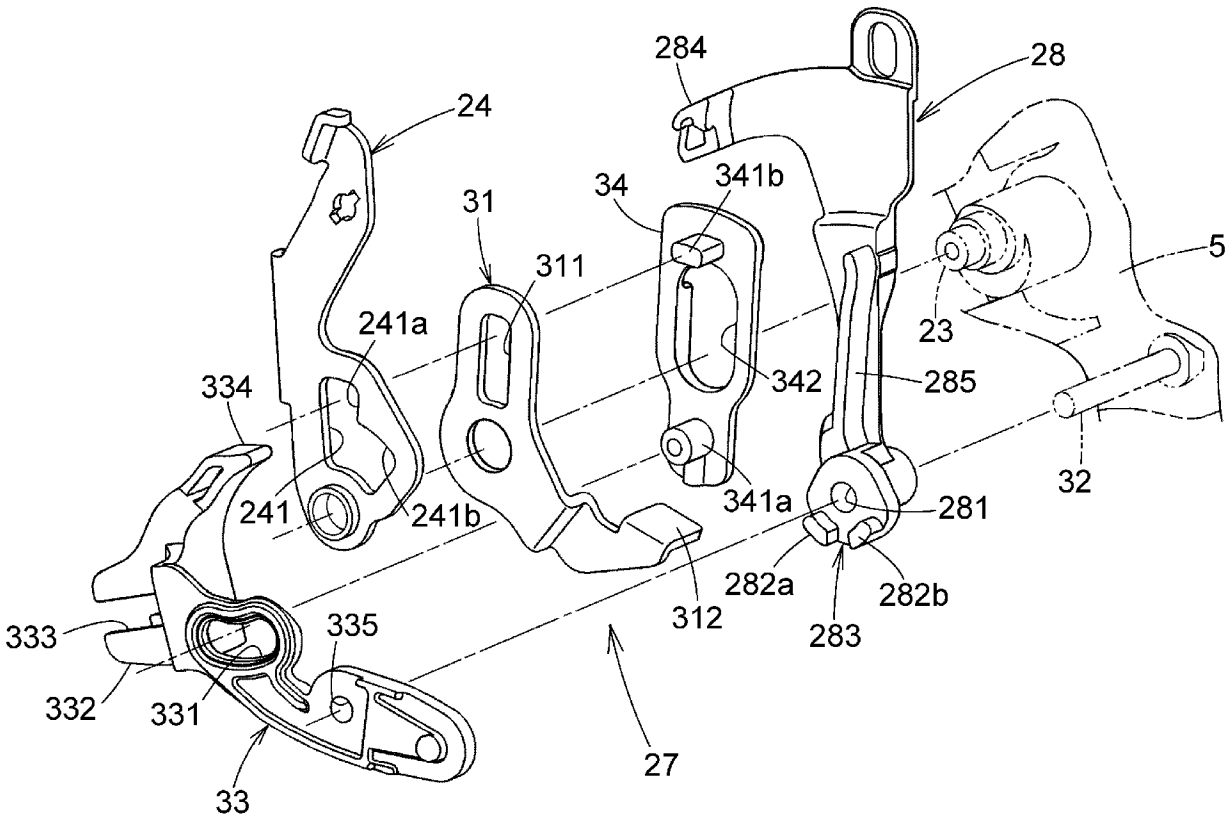
FIG. 4 is an exploded perspective view of a childproof lock mechanism and a double lock lever.
Figure 5:
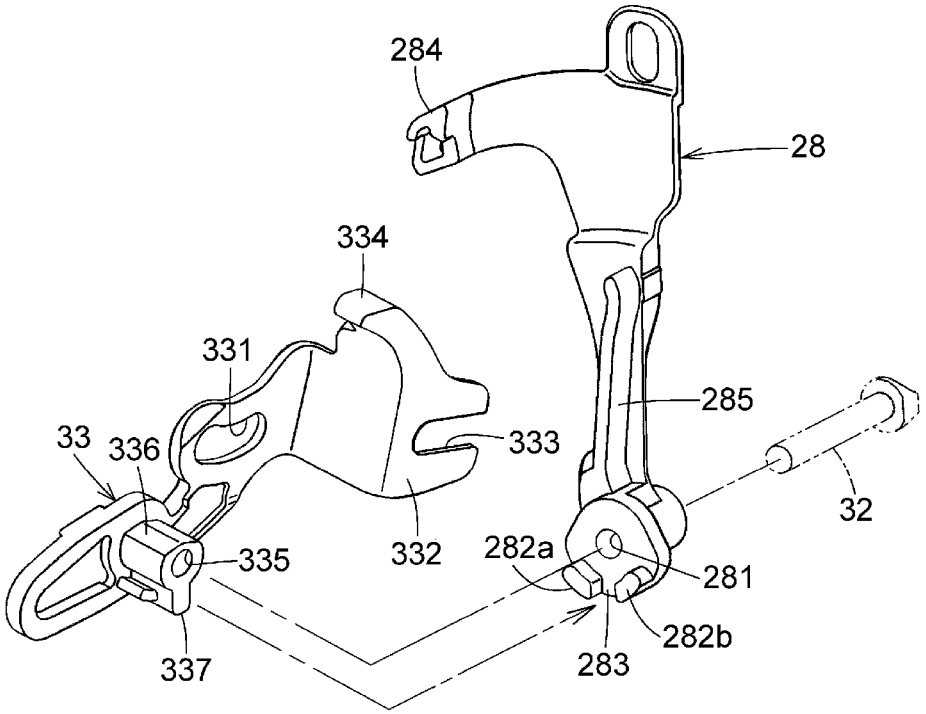
FIG. 5 is a perspective view for explaining of a coordinated relation between a childproof lever and the double lock lever.
Figure 9:
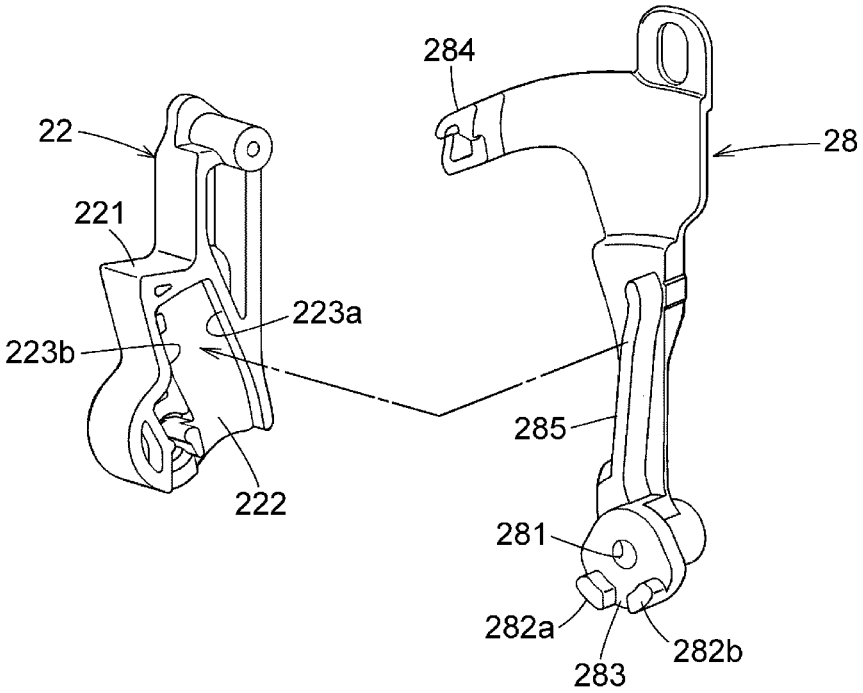
FIG. 9 is a perspective view for explaining a coordinated relation between an open link and the double lock lever.

The childproof lock mechanism 27 comprises, shown also in FIG. 4 and FIG. 9;

a release lever 31 that an intermediate part is supported rotatably by the axis 23 of the inside lever 24 so as to be overlapped with the vehicle outside surface of the inside lever 24 and is formed a long hole 311 of the up-and-down direction in an upper portion rather than the axis 23;

a childproof lever 33, made of a synthetic resin, an intermediate part of which is supported by a support shaft 32 provided on the casing 5 and is facing to the front and forward direction, at the lower end part of the back side in the casing 5, the axis 32 is facing to inside and outside vehicle direction; and a connect lever 34 of the up-and-down direction, being overlapped with the vertical outside surface of the release lever 31 and movable in the up-and-down direction, which is provided with a lower connection projection 341 and an upper connection projection 341*b* facing to the inside direction of the vehicle on the lower part and upper part respectively, and which has a penetration hole 342 of the up-and-down direction between the two projections in which the axis 23 penetrates.

The end of inner side of the vehicle of the support shaft 32 is supported in the inside of the cover 4, the end of the outer side of the support shaft 32 is supported in the inside of the casing 5, respectively.

In the back end of the release lever 31, a release part 312 facing to the outside direction of the vehicle is integrally formed, which enable to move the open link 22 upper direction (in to the release direction) by hitting the lower end of the open link 22.

An upper connection projection 341*b* of the connect lever 34 is penetrated the long hole 311 of the release lever 31 slidably and is fitted in the fitting hole 241 of the inside lever 24. The lower connection projection 341*a* of the connect lever 34 is slidably fitted in a circular connecting hole 331 of the childproof lever 33, the connecting hole 331 is long in the front and back direction and is provided under the axis 23 and in front part of the childproof lever 33.

In the front lower part in the casing 5, the childproof-double-lock motor 35 which is rotatable in forward and reverse direction is accommodated, where the axis-of-rotation line is inclined forward. On a spiral gear 36 which fixed to the motor shaft, a cylindrical moving member 37 which moves in the direction of the shaft by the forward and reverse rotation is engaged.

On the moving member 37, a pair of drive pins 371 are provided facing to the direction of the inner and outside of the vehicle.

A bifurcated connecting portion 332 is formed at a front tip of the childproof lever 33 which can sandwich the moving member 37 from back side, and a front tip of the childproof lever 33 is connected to the moving member 37 by fitting a U character shape notched groove 333 formed in this connecting portion 332 to a pair of drive pins 371 of the moving member 37 from back side. At the front end of the childproof lever 33, a detection lever section 334 which extends toward the rear upward is integrally formed so that the connecting portion 332 is connected to the detection lever section 334.

When the childproof lever 33 is in the childproof unlocking position as shown in FIG. 1, the front of the upper end part of the detection lever section 334 is contacted with a switch pin 381 of the childproof locking detection switch 38 provided in the lower end part of the switch plate 29, and the switch pin 381 is pushed in, so that the childproof unlocking state is detected.

Moreover, when the childproof lever 33 rotates to the counterclockwise direction from the childproof unlocking position shown in FIG. 1 to the childproof locking position, by the operation of the childproof-double-lock motor 35, the front of the upper end part of the detection lever section 334 moves away from the switch pin 381 and moves below, so that the childproof locking state is detected (details are mentioned later).

The switch plate 29 comprises; the lock/unlock motor 13; a 1st switch plate 292 which turns on electricity to a door opening-and-closing detection switch 39 and a lock/unlock detection switch 40; and a 2nd switch plate 293 which turns on electricity to the childproof-double-lock motor 35, a childproof locking detection switch 38 and a double lock detection switch 41; and is formed by connecting the 2nd switch plate 293 to the 1st switch plate 292. In addition, the door opening-and-closing detection switch 39 and the lock/unlock detection switch 40 are attached on the 1st switch plate 292, and the childproof locking detection switch 38 and the double lock detection switch 41 are attached on the 2nd switch plate 293, respectively (refer to FIG. 1).

Figure 13:
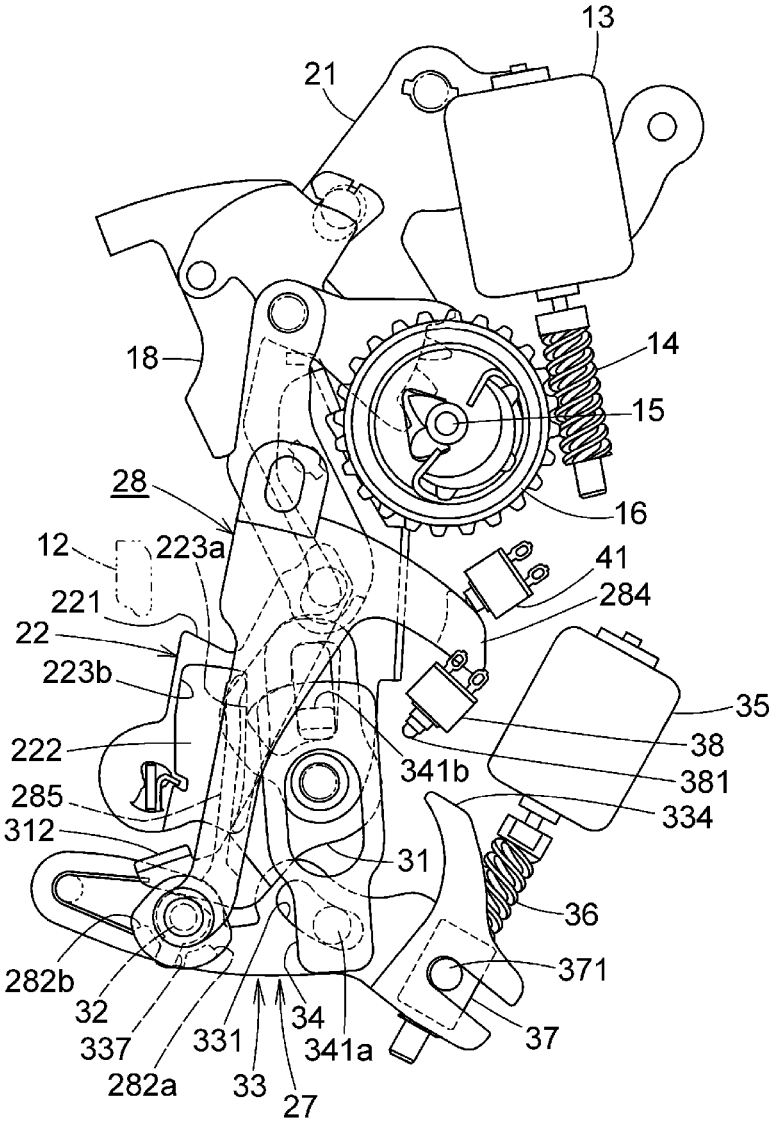
FIG. 13 is a side view of the principal part of the door latch device when the double lock lever is the double locking state, seen in the direction of the outside of the vehicle.

As shown in FIG. 9 and FIG. 13 in detail, on the open link 22, in lower half part of the outer side of the vehicle, a concave portion 222 of the up-and-down direction is formed, which is released by the direction of outside the vehicle and the lower part. Further, on the inner side of the vehicle of the double lock lever 28, where a part of the up-and-down direction of the open link 22 is facing to, a rib-shaped blocking portion 285 is formed. The upper half part of the blocking portion 285 is formed to fit in the concave portion 222 of the open link 22 so that the fitting part can move relatively in the front-back direction.

When the open link 22 and the double lock lever 28 are in the unlocking position as shown in FIG. 1 and FIG. 10, the blocking portion 285 of the double lock lever 28 is, in the concave portion 222 of the open link 22 opposed to a front side blocked wall portion 223*a* which is a blocked portion, by approaching or by hitting, and is spaced from the wall part 223*b* on the backside in the concave portion 222.

So that, when the double lock lever 28 is in the double unlocking position, the open link 22 is enabled to move from the unlocking position shown in FIG. 1 and FIG. 10 to the locking position (the counterclockwise direction), based on the locking operation of the knob lever 21.

Moreover, it is although detailed explanation is mentioned later, when the open link 22 is in the locking position and the double lock lever 28 is moved to the double locking position, the blocking portion 285 of the double lock lever 28 approaches or hits the blocked wall portion 223*a* of the open link 22 on the front side, so that the movement of the open link 22 toward the unlocking position is blocked.

As shown in FIG. 4-FIG. 8, in the lower end part of the double lock lever 28, a shaft hole 281 of front and back direction is formed. By rotatably fitting the shaft hole 281 to the support shaft 32 which supports the childproof lever 33, the double lock lever 28 is supported by the support shaft 32 with the childproof lever 33 in a state that a part of the double lock lever 28 where facing to up-down direction is overlapped with a part of the open link 22 on the side of outside the vehicle.

In a lower end part of the double lock lever 28, on the inner side of the vehicle, around the central part supported by the support shaft 32, two driven projections 282*a* and 282*b* are formed, separated in the direction of the circumference about the shaft hole 281, each of which projects toward the direction of the inside of the vehicle. Between the facing surfaces of both driven projections 282*a* and 282*b*, a space 283 having necessary width released in the direction of the inner side of the vehicle and up-and-down direction is formed.

On the other hand, in the portion which counters the lower end part of the double lock lever 28 in childproof lever 33, namely, on the side of outside the vehicle of the central part supported by the support shaft 32 in the childproof lever 33, a projection 336 is formed which facing to the direction of outside the vehicle in which a shaft hole 335 is formed.

On the undersurface of the projection 336, a plate-like drive projection 337 is integrally formed in downward direction. The drive projection 337 has a thickness by which the tip part of outside the vehicle of the drive projection is fitted in the space 283 between the driven projection 282*a* and the driven projection 282*b* with a margin in space.

In addition, the drive projection 337 and the driven projections 282*a*, 282*b* correspond to the interlocking device of the present invention.

In addition, although detailed explanation is mentioned later, a linked relation between the drive projection 337 and the driven projections 282*a* and 282*b*, and an interlocking relation between the childproof lever 33 and the double lock lever 28 are as follows.

Figure 6:
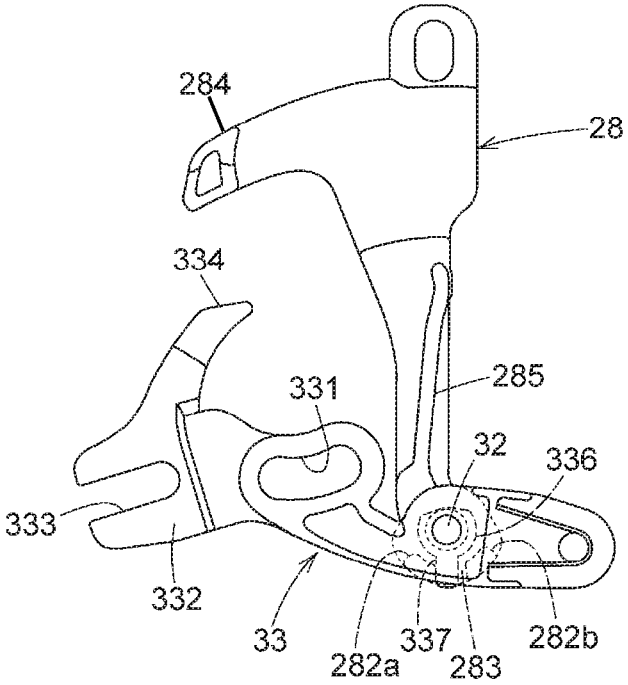
FIG. 6 is a side view of a coordinated relation between the childproof lever and the double lock lever when the childproof lever is in a first position, seen in a direction of an inner side of the vehicle.

When the childproof lever 33 is in the first position (the childproof unlocking position) shown in FIG. 1 and FIG. 10, as shown in FIG. 6 enlarged, the drive projection 337 fitted in the space 283 of the double lock lever 28 approaches or contacts with the driven projection 282*a* on the front side, and is apart from the driven projection 282*b* on the backside.

Figure 7:
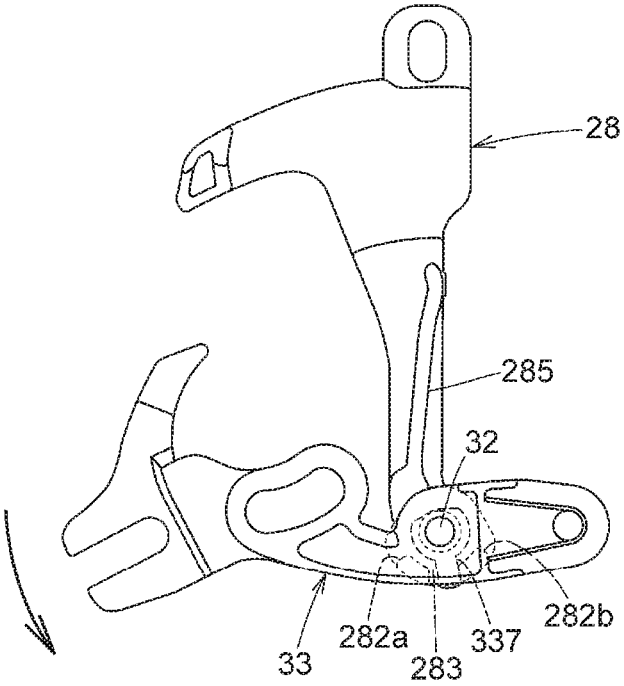
FIG. 7 is, the same, a side view of the coordinated relation between the childproof lever and the double lock lever when the childproof lever is moved into a second position, seen in the direction of the inner side of the vehicle.
Figure 11:
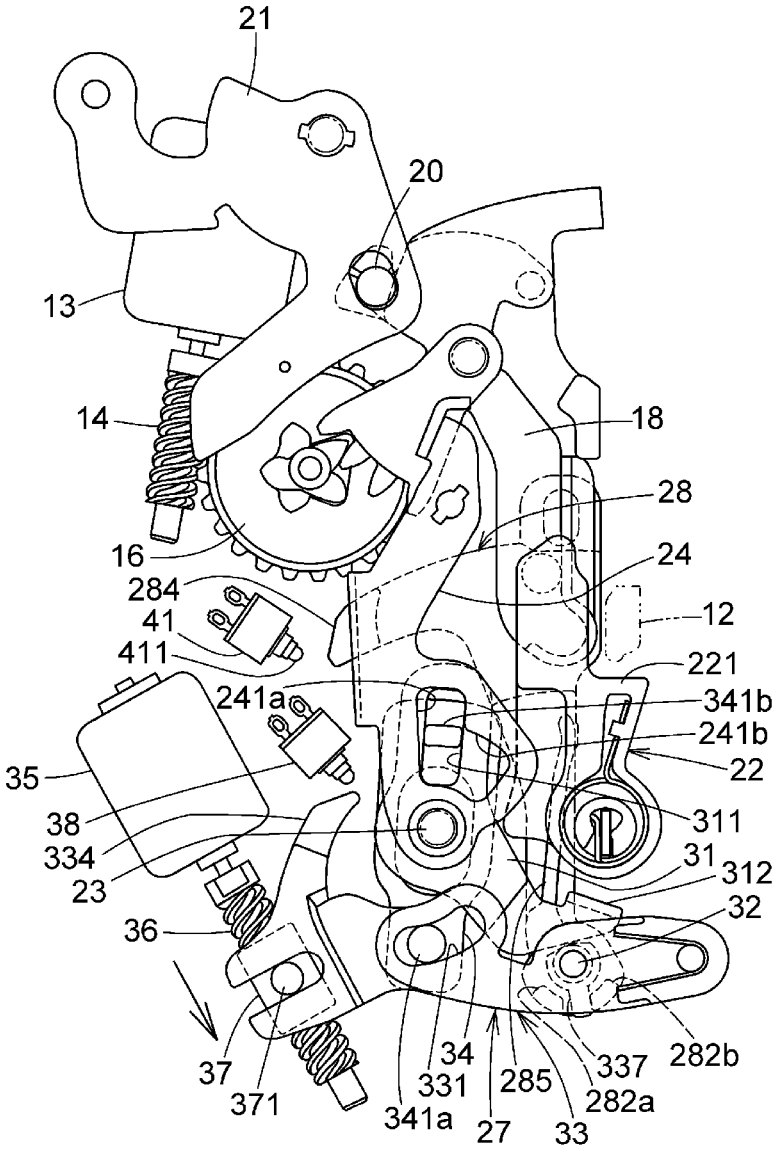
FIG. 11 is a side view of the principal part of the door latch device when the childproof lever is a childproof locking state, seen in the direction of the inner side of the vehicle.

As shown in FIG. 11, when the childproof lever 33 is rotated counterclockwise direction, by the childproof-double-lock motor 35 from the first position to the second position (the childproof locking position), as shown in FIG. 7, the drive projection 337 only rotates inside of the space 283 to the position where approached or contacted with the driven projection 282*b* on the backside, the rotation torque of the childproof lever 33 is not transmitted to the double lock lever 28.

Figure 8:
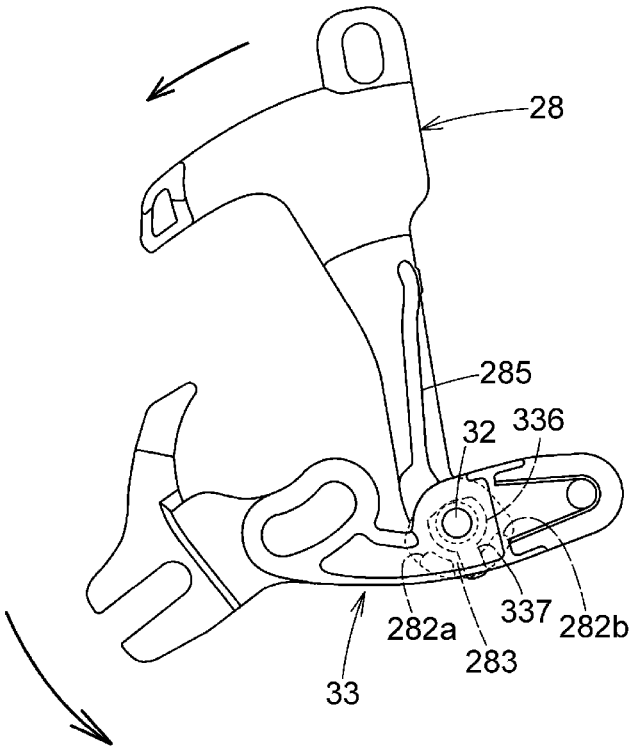
FIG. 8 is, the same, a side view of the coordinated relation between the childproof lever and the double lock lever when the childproof lever is moved into a third position, seen in the direction of the inner side of the vehicle.

As shown in FIG. 11, when the childproof lever 33 is rotated furthermore by the childproof-double-lock motor 35 to the counterclockwise from the above second position to the third position (the double locking position), as shown in FIG. 8, the rotation drive power of the drive projection 337 is transmitted to the driven projection 282*b* on the backside, so that the double lock lever 28 is interlocked with the childproof lever 33 and is rotated in counterclockwise direction about the support shaft 32, and the double lock lever 28 becomes double locking state.

Next, each of actions of the childproof lock mechanism 27 and the double lock lever 28 is explained in detail.

When the childproof lock mechanism 27 is in the childproof unlocking state, the childproof lever 33 is stopped at the first position (the childproof unlocking position) shown in FIG. 1 and FIG. 9.

In this case, as mentioned above, the upper connection projection 341*b* of the connect lever 34 is penetrated the long hole 311 of the release lever 31 and fitted in the vertically long hole 241*a* of the inside lever 24. Therefore, when the lock/unlock lever 18 and the open link 22 are in the unlocking position, if the inside lever 24 is carried out the release operation into the door open direction (the counterclockwise direction in FIG. 1 and FIG. 9) based on the door opening operation by the inside handle (not illustrated), the drive power is transmitted to release lever 31 through the upper connection projection 341*b*, and then the release lever 31 rotates counterclockwise direction linked with the inside lever 24.

Accordingly, the release part 312 of the release lever 31 contacts with the lower end of the open link 22 and pushes up the open link 22, then the open lever 12 is rotated in the release direction, so that the engagement of the clutch of latch 9 and the ratchet 11 is canceled and the door can be opened.

On the other hand, as shown in FIG. 10, when the childproof lock mechanism 27 is let into the childproof locking state, namely, for example, the remote controller switch etc. which is provided in the driver's seat side etc. is turned into the childproof locking position, or on a predetermined condition of speed, a parking range, or a foot brake, etc., operating the childproof-double-lock motor 35 into the lock direction and moving the childproof lever 33 into the second position (the childproof locking position) by rotation of the spiral gear 36 in the counterclockwise direction, the connect lever 34 is moved below through the lower connection projection 341*a* which is fitted into the connecting hole 331 of the childproof lever 33.

If it is carried out, the upper connection projection 341*b* is lowered to the upper part of the backward hole 241*b* of the fit hole 241 of the inside lever 24.

In addition, if the childproof lever 33 moves to the childproof locking position where is the second position, the detection lever section 334 is separated from the switch pin 381 of the detection switch 38, and a childproof locking signal is transmitted to a control circuit equipment etc., so that the childproof-double-lock motor 35 is stopped.

If childproof lever 33 moves to the second position, the door latch device 1 becomes the childproof locking state. In this state, if the lock/unlock lever 18 is set to unlocking state by controlling the lock knob (not shown) in the door and the inside lever 24 is operated into the release direction, since the inside lever 24 is swing away even, the drive power of the inside lever 24 is no longer transmitted to the release lever 31 through the upper connection projection 341*b*.

Therefore, at the time of the childproof locking state, since it becomes disabled to move the open lever 12 into the release direction via the release lever 31 and the open link 22, a child etc. riding in the vehicle cannot open the door from inner side of the vehicle by the release operation of the inside lever 24.

In addition, even in the childproof locking state, when the lock/unlock lever 18 is in the unlocking position, by operating the outside handle of the door to carry out the release operation of the outside lever 26 to the door open direction, since the open lever 12 may be moved in the release direction through the open link 22, so that the door can be opened from the outside of the vehicle.

Moreover, as mentioned above, when the childproof lever 33 is moved to and stops the childproof locking position where is the second position, as shown in FIG. 7, since the drive projection 337 prepared in the childproof lever 33 is only moving toward the back driven projection 282*b* inside of the space 283 provided in the double lock lever 28, the drive power of childproof lever 33 by the childproof-double-lock motor 35 is not transmitted to the double lock lever 28.

In addition, when the childproof locking state is canceled, it can change to the childproof unlocking state, by the childproof unlocking operation of the remote controller switch etc. which are provided in the driver's seat side etc., or by moving the childproof lever 33 to the first position by operating the childproof-double-lock motor 35 in the unlocking direction contrary to the above, on the condition of the speed, the parking garage, the foot brake etc.

When the door is in a fully closed state, and the lock/unlock lever 18 and the open link 22 are in the locking position, if a portable remote controller switch etc. is carried out the double lock operation and rotates the childproof-double-lock motor 35 into the lock direction, as shown in FIG. 11, the childproof lever 33 is moved counterclockwise, from the first position to the third position (the double locking position) passing through the second position.

If it is carried out, as mentioned above, the drive projection 337 of the childproof lever 33 fitted in the space 283 in the double lock lever 28 contacts the driven projection 282*b* on the backside which is a rotating direction of the drive projection 337, as shown in FIG. 8 and FIG. 12, the double lock lever 28 is linked with the childproof lever 33 and is rotated a predetermined angle to the double lock direction (the counterclockwise direction in FIG. 11) about the support shaft 32.

In addition, when the double lock lever 28 is rotates to the double locking position, the tip part of a detection lever section 284 which formed in the upper end and extending toward the forward direction contacts with a switch pin 411 of the double lock detection switch 41 formed on the 2nd switch plate 293 and pushes the switch pin 411, a double lock signal is transmitted to the control circuit equipment etc., then, the childproof-double-lock motor 35 is stopped.

If the double lock lever 28 moves to the double locking position, as shown in FIG. 13 (a figure which looked at FIG. 12 from the back side), the upper end part of the blocking portion 285 formed in the double lock lever 28 approaches or contacts with the blocked wall portion 223*a* in the front (in FIG. 13, it is right-hand side) in the concave portion 222 of the open link 22 which is moving to the locking position with the lock/unlock lever 18, so that the door latch device 1 becomes double locking state.

In double locking state, even if the lock knob inside the vehicle is unlocked, the lock/unlock lever 18 and the open link 22 linked with the lock/unlock lever 18 are prevented to move to the unlocking position from the locking position. Namely, in double locking state, the lock knob is unlocked and if the lock/unlock lever 18 and the open link 22 is going to move in the unlocking position direction (positions shown in FIG. 1 and FIG. 10), as shown in FIG. 13, the blocked wall portion 223*a* of the front side of the open link 22 contacts with the blocking portion 285 of the double lock lever 28 stopping at the double locking position, so that the movement of the open link 22 and the lock/unlock lever 18 in the unlocking position direction are prevented.

Thereby, when the door latch device 1 is in the double locking state, not only the open operation of the door by the outside handle of door, even if the lock knob of the vehicle is operated unjustly to the unlocking position direction from the outside of the vehicle etc., there is no possibility that the door may be opened. In addition, when canceling the double locking state by moving the double lock lever 28 into the double unlocking position direction, it may be moved the childproof lever from the third position to the first position, by operating the portable remote controller switch etc. for rotating the childproof-double-lock motor 35 to the unlocking direction contrary to the above.

The driving of the double lock lever 28 to the double unlocking position direction in this case is carried out by contacting the drive projection 337 of the childproof lever 33 to the driven projection 282*a* by the front side of the double lock lever 28 which is the rotation direction of the drive projection 337.

As explained above, since, according to the door latch device concerning the above enforcement, the childproof lever 33 and the double lock lever 28 of childproof lock mechanism 27 are supported on a coaxial by the support shaft 32 extending to the inside and outside the vehicle direction, and the double lock lever 28 is driven directly in the double locking position direction and the double unlocking position interlocking with the childproof lever 33 via the interlocking mechanism prepared in the facing surface of the central parts of them, therefore, in the casing 5, the childproof lock mechanism 27 and the double lock lever 28 can be accommodated closely and compactly, so that the miniaturization of the casing 5 and the door latch device can be attained.

Moreover, since, by driving the childproof lever 33 of the childproof lock mechanism 27 directly by the childproof-double-lock motor 35 and only moving the childproof lever 33 to the first position, the second position, or the third position passed through the second position, while being able to make the childproof lock mechanism 27 into the childproof locking state and the childproof unlocking state, and being able to move the double lock lever 28 to the double locking position and the double unlocking position, so that the childproof locking mechanism and the double locking mechanism are simplified.

Further, since the release lever 31 and the connect lever 34 constituting the childproof lock mechanism 27 are arranged between the open link 22 and the childproof-double-lock motor 35 so as to be overlapped with the inside lever 24, and is assembled by supporting them by the axis 23 which supports the inside lever 24 in upper part near the childproof lever 33, the composition component of the childproof lock mechanism 27 is aggregated between the open link 22 and the childproof-double-lock motor 35, so that the door latch device can be miniaturized much more.

The interlocking device of the childproof lever 33 and the double lock lever 28 comprises the drive projection 337 prepared in the childproof lever 33 side and two driven projections 282*a* and 282*b*, prepared in the double lock lever 28 side, having the space 283 in which the drive projection 337 is fitted. Since, when the childproof lever 33 moves to the third position passing through the second position, the drive projection 337 contacts to the projection 282*b*, and, similarly, when the childproof lever 33 moves to the first position from the third position, the drive projection 337 contacts to the projection 282*a*, respectively, thereby the double lock lever 28 is moved into the double locking position and into the double unlocking position direction, respectively, so that the composition of the interlocking device can be simple. Further, since the driven projections 282*a*, and 282*b* are prepared in the facing surface of the central part supported by the support shaft 32 of the childproof lever 33 and the double lock lever 28 integrally, the interlocking device can be compactly stored around the circumference of the support shaft 32.

The open link 22 and the double lock lever 28 are arranged such that a part of them may be opposed, and when the open link 22 is in the locking position and the double lock lever is in the double locking position, the blocking portion 285 prepared in the facing surface of the double lock lever 28 approaches or contacts with the one blocking wall section 223*a* in the concave portion 222 prepared in the facing surface by the side of open link 22, the open link 22 is blocked to move in the unlocking position direction, so that the composition of the means which lets the door latch device to the double locking state is simple.

An embodiment of the present invention is described above. Following various modifications and variations to the above embodiment may be made without departing from the scope of claims.

According to the above embodiment, the interlocking device which interlocking the childproof lever 33 and the double lock lever 28 is a composition including a drive projection 337 prepared in the childproof lever 33 side, and two driven projections 282*a* and 282*b* prepared in the double lock lever 28 side having the space 283 in which the drive projection 337 is fitted.

Figure 14:
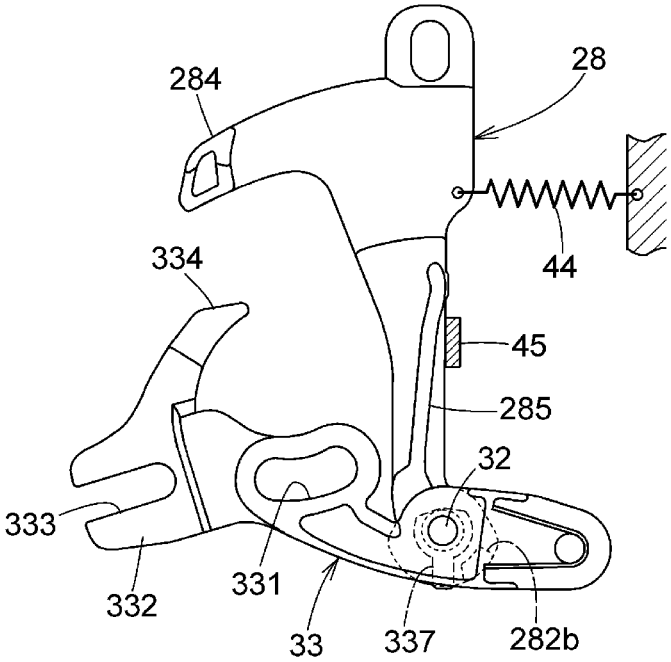
FIG. 14 is a perspective view of a modification of an interlocking device between the childproof lever and the double lock lever, seen in the direction of the inner side of the vehicle.

However, following interlocking device shown in FIG. 14 can also be used.

Namely, among two driven projections 282*a* and 282*b* prepared in the double lock lever 28, the driven projection 282*a* in the front side is omitted, it has only the driven projection 282*b* on the backside. When the childproof lever 33 passes the second position and moves to the third position, as same as the above embodiment, the drive projection 337 prepared in the childproof lever 33 side contacts with the driven projection 282*b*, then the double lock lever 28 moves to the double locking position direction linked with the childproof lever 33.

Moreover, for a means to move the double lock lever 28 in the double unlocking position direction, a tension spring 44 of which one end is hold by an immobility component like the casing 5 (a torsion spring which fitted to the support shaft 32 may be sufficient) etc. is used. While the childproof lever 33 is moved to the first position from the third position, the double lock lever 28 in the double locking position is moved to the double unlocking position direction by biasing force of the tension spring 44, and stopped in the double unlocking position by a stopper 45 provided in the casing 5 etc.

The invention claimed is:

1. A door latch device in a door of a motor vehicle, the door latch device comprising:

an engagement unit having an engagement mechanism adapted to engage with a striker of a vehicle body of the motor vehicle; and an actuator unit combined with the engagement unit and having an operation mechanism for operating the engagement mechanism;

wherein the operation mechanism comprises:

an inside lever that carries out a release operation to the engagement mechanism based on a door opening operation of an inside handle provided in the door inside the motor vehicle;

a lock/unlock lever movable to an unlocking position and a locking position, based on an operation of a lock knob for locking and unlocking operations provided in the door inside the motor vehicle;

an open link interlocked with the lock/unlock lever so as to be movable with the lock/unlock lever to the unlocking position and the locking position, wherein, when in the unlocking position, the open link is enabled to release an engagement of the engagement mechanism with the striker based on a release operation of an outside handle provided in the door outside of the motor vehicle, and when in the locking position, the open link is disabled to release the engagement of the engagement mechanism with the striker;

a childproof lock mechanism having a childproof lever movable to a first position, corresponding to a childproof unlocking state of the childproof lock mechanism, and in which a transfer of the release operation of the inside lever to the engagement mechanism is allowed, such that the open link is enabled to release the engagement of the engagement mechanism with the striker, and a second position, corresponding to a childproof locking state of the childproof lock mechanism, and in which the transfer of the release operation of the inside lever to the engagement mechanism is prevented, such that the open link is disabled from releasing the engagement of the engagement mechanism with the striker;

a double lock lever rotatable to a double unlocking position, in which the movement of the open link into the locking position is allowed, and to a double locking position, in which the movement of the open link into the unlocking position is blocked; and a motor for rotating the childproof lever to the first position, the second position, and a third position past the second position, and the double lock lever is rotatable to the double locking position by the rotation of the childproof lever to the third position by the motor;

wherein, the childproof lever and the double lock lever are supported by a support shaft, and the childproof lever and the double lock lever are interlocked by an interlocking device, such that the double lock lever is rotated to the double locking position when the childproof lever is rotated to the third position;

wherein the interlocking device comprises: a drive section provided on the childproof lever, and a driven section provided on the double lock lever, wherein, when the childproof lever passes through the second position and rotates to the third position, the drive section hits the driven section and the double lock lever is rotated to the double locking position by the childproof lever; and wherein the driven section comprises two pieces separated in a direction of a circumference centered on the support shaft, with a space formed between the two pieces, the drive section is fitted to the driven section so that a rotation of the childproof lever through a predetermined angle, centered on the support shaft, can be carried out by the motor, and when the childproof lever passes through the second position and rotates to the third position, and when the childproof lever rotates to the first position from the third position, the drive section selectively hits the two pieces of the driven section, such that the double lock lever is rotated to the double locking position and to the double unlocking position, respectively.

2. The door latch device of claim 1, wherein the open link and the double lock lever are arranged so that at least one part of them are facing each other, a blocked portion is located on a surface of the open link facing the double lock lever, and a blocking portion is located on a surface of the double lock lever facing the open link, and wherein when the open link is in the locking position and the double lock lever is in the double locking position, the blocking portion approaches or hits the blocked portion, so that the movement of the open link to the unlocking position is blocked.

3. A door latch device in a door of a motor vehicle, the door latch device comprising:

an engagement unit having an engagement mechanism adapted to engage with a striker of a vehicle body of the motor vehicle; and an actuator unit combined with the engagement unit and having an operation mechanism for operating the engagement mechanism;

wherein the operation mechanism comprises:

an inside lever that carries out a release operation to the engagement mechanism based on a door opening operation of an inside handle provided in the door inside the motor vehicle;

a lock/unlock lever movable to an unlocking position and a locking position, based on an operation of a lock knob for locking and unlocking operations provided in the door inside the motor vehicle;

an open link interlocked with the lock/unlock lever so as to be movable with the lock/unlock lever to the unlocking position and the locking position, wherein, when in the unlocking position, the open link is enabled to release an engagement of the engagement mechanism with the striker based on a release operation of an outside handle provided in the door outside of the motor vehicle, and when in the locking position, the open link is disabled to release the engagement of the engagement mechanism with the striker;

a childproof lock mechanism having a childproof lever movable to a first position, corresponding to a childproof unlocking state of the childproof lock mechanism, and in which a transfer of the release operation of the inside lever to the engagement mechanism is allowed, such that the open link is enabled to release the engagement of the engagement mechanism with the striker, and a second position, corresponding to a childproof locking state of the childproof lock mechanism, and in which the transfer of the release operation of the inside lever to the engagement mechanism is prevented, such that the open link is disabled from releasing the engagement of the engagement mechanism with the striker;

a double lock lever movable to a double unlocking position, in which the movement of the open link into the locking position is allowed, and to a double locking position, in which the movement of the open link into the unlocking position is blocked; and a motor for moving the childproof lever to the first position, the second position, and a third position past the second position, and the double lock lever is movable to the double locking position by the movement of the childproof lever to the third position by the motor;

wherein, the childproof lever and the double lock lever are supported by a support shaft, and the childproof lever and the double lock lever are interlocked by an interlocking device, such that the double lock lever is moved to the double locking position when the childproof lever is moved to the third position; and wherein the open link and the double lock lever are arranged so that at least one part of them are facing each other, a blocked portion is located on a surface of the open link facing the double lock lever, and a blocking portion is located on a surface of the double lock lever facing the open link, and wherein when the open link is in the locking position and the double lock lever is in the double locking position, the blocking portion approaches or hits the blocked portion, so that the movement of the open link to the unlocking position is blocked.

4. A door latch device in a door of a motor vehicle, the door latch device comprising:

an engagement unit having an engagement mechanism adapted to engage with a striker of a vehicle body of the motor vehicle; and an actuator unit combined with the engagement unit and having an operation mechanism for operating the engagement mechanism;

wherein the operation mechanism comprises:

an inside lever that carries out a release operation to the engagement mechanism based on a door opening operation of an inside handle provided in the door inside the motor vehicle;

a lock/unlock lever movable to an unlocking position and a locking position, based on an operation of a lock knob for locking and unlocking operations provided in the door inside the motor vehicle;

an open link interlocked with the lock/unlock lever so as to be movable with the lock/unlock lever to the unlocking position and the locking position, wherein, when in the unlocking position, the open link is enabled to release an engagement of the engagement mechanism with the striker based on a release operation of an outside handle provided in the door outside of the motor vehicle, and when in the locking position, the open link is disabled to release the engagement of the engagement mechanism with the striker;

a childproof lock mechanism having a childproof lever movable to a first position, corresponding to a childproof unlocking state of the childproof lock mechanism, and in which a transfer of the release operation of the inside lever to the engagement mechanism is allowed, such that the open link is enabled to release the engagement of the engagement mechanism with the striker, and a second position, corresponding to a childproof locking state of the childproof lock mechanism, and in which the transfer of the release operation of the inside lever to the engagement mechanism is prevented, such that the open link is disabled from releasing the engagement of the engagement mechanism with the striker;

a double lock lever movable to a double unlocking position, in which the movement of the open link into the locking position is allowed, and to a double locking position, in which the movement of the open link into the unlocking position is blocked; and a motor for moving the childproof lever to the first position, the second position, and a third position past the second position, and the double lock lever is movable to the double locking position by the movement of the childproof lever to the third position by the motor;

wherein, the childproof lever and the double lock lever are supported by a support shaft, and the childproof lever and the double lock lever are interlocked by an interlocking device, such that the double lock lever is moved to the double locking position when the childproof lever is moved to the third position;

wherein the interlocking device comprises: a drive section provided on the childproof lever, and a driven section provided on the double lock lever, wherein, when the childproof lever passes through the second position and moves to the third position, the drive section hits the driven section and the double lock lever is moved to the double locking position by the childproof lever, and wherein the open link and the double lock lever are arranged so that at least one part of them are facing each other, a blocked portion is located on a surface of the open link facing the double lock lever, and a blocking portion is located on a surface of the double lock lever facing the open link, and wherein when the open link is in the locking position and the double lock lever is in the double locking position, the blocking portion approaches or hits the blocked portion, so that the movement of the open link to the unlocking position is blocked.

* * * * *